US006732742B2

(12) United States Patent
Spatafora et al.

(10) Patent No.: US 6,732,742 B2
(45) Date of Patent: May 11, 2004

(54) METHOD OF CONDITIONING CIGARS

(75) Inventors: Mario Spatafora, Bologna (IT); Luca Borderi, Sasso Marconi (IT); Gianluca Parisini, Bologna (IT)

(73) Assignee: G. D S.p.A., Bologna (IT)

( * ) Notice: Subject to any disclaimer, the term of this patent is extended or adjusted under 35 U.S.C. 154(b) by 0 days.

(21) Appl. No.: 10/196,279

(22) Filed: Jul. 17, 2002

(65) Prior Publication Data

US 2003/0019500 A1 Jan. 30, 2003

(30) Foreign Application Priority Data

Jul. 24, 2001 (IT) ..... BO2001A0469

(51) Int. Cl.[7] ..... A24F 13/24

(52) U.S. Cl. ..... 131/254; 131/253; 131/255; 131/290

(58) Field of Search ..... 131/91, 92, 93, 131/255, 281, 254, 290, 79

(56) References Cited

U.S. PATENT DOCUMENTS 2,800,133 A 7/1957 Sundberg
3,610,254 A * 10/1971 Shellenberg et al. ..... 131/79
3,636,958 A 1/1972 Sundberg et al.
4,047,535 A 9/1977 Wimmer

FOREIGN PATENT DOCUMENTS

DE 2614220 10/1977
DE 26 14 220 * 10/1977

* cited by examiner

*Primary Examiner*—Dionne A. Walls
(74) *Attorney, Agent, or Firm*—Davidson Berquist Klima & Jackson, LLP

(57) ABSTRACT

In a cigar-making machine, the cigars advance continuously in orderly succession occupying a plurality of respective pockets transported by a conveyor along a predetermined feed path toward a piercing station where they are engaged by a plurality of needles fitted to respective movable heads; the heads are caused to advance parallel to the predetermined feed path followed by the cigars, proceeding continuously and synchronously with the pockets in such a manner that each of the single cigars can be pierced by a corresponding needle with a relative hole, aligned substantially on a longitudinal axis of the cigar.

7 Claims, 2 Drawing Sheets

METHOD OF CONDITIONING CIGARS

BACKGROUND OF THE INVENTION

The present invention relates to a method of conditioning cigars.

It is common practice, when smoking a cigar, to pierce one end longitudinally so that the smoke can be drawn easily into the mouth when the cigar is lit.

To accomplish this operation, use has always been made of manual punch devices typically comprising a tubular body in which to locate the end of a single cigar, and a punch positioned to pierce the cigar when offered to the tubular body.

With the advent of mechanization and its impact on the manufacture of tobacco products generally, this piercing operation is now included among the functions of normal cigar making machines.

In effect, the prior art embraces piercing units consisting in heads equipped with a plurality of needles placed to engage a corresponding plurality of cigars disposed parallel one with another and arranged in an ordered succession.

More exactly, ordered groups of cigars advancing through the machine are directed into a piercing station and thereupon held stationary so as to enable their engagement with the aforementioned heads carrying the plurality of needles.

The needles are heated so that the tobacco will be subjected to a stretching action, designed to ensure that the hole retains its shape rather than closing up once the needle is withdrawn.

For the heat-stretching action to be effective, clearly enough, the needle must remain in the hole for a certain period of time.

Consequently, the feed unit by which the cigars are advanced must pause for a duration at least equal to the aforementioned period of time.

Conventional machines thus betray the drawback of requiring lengthy cycle times, and this has obvious repercussions on the operating efficiency and the profitability of such machines.

Another drawback connected with the use of prior art machines is that, in seeking to avoid further prolongation of the pause, attempts have been made to speed up the steps of inserting and withdrawing the needle into and from the cigar; this expedient has negative consequences however, since the cigars can suffer damage from the substantially impulsive action of the selfsame needle.

The object of the present invention is to provide a method of conditioning cigars, unaffected wholly or in part by the drawbacks mentioned above and at the same time functional and economical to operate.

SUMMARY OF THE INVENTION

The stated object is realized, according to the invention, in a method of conditioning cigars that comprises the steps of arranging the cigars in an ordered succession on respective holder elements, advancing the cigars with the holder elements along a predetermined feed path, and piercing a hole in at least one end of each cigar, substantially parallel with a longitudinal axis of the selfsame cigar. Advantageously, the cigars are caused to advance continuously along the predetermined path, and the step of piercing a hole in each cigar is accomplished during the continuous movement of the cigars along the predetermined path.

The present invention relates also to a cigar making machine capable of conditioning cigars in the manner of the present invention.

Such a machine comprises conveyor means by which the cigars are advanced along a predetermined feed path, a distribution station at which the cigars are dispensed onto a plurality of holder elements afforded by the conveyor means, and piercing means operating in conjunction with the conveyor means in such a way as to penetrate at least one end portion presented by each of the cigars advancing along the predetermined path. In accordance with the method disclosed, the conveyor means operate continuously so as to advance the cigars continuously along the predetermined path.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
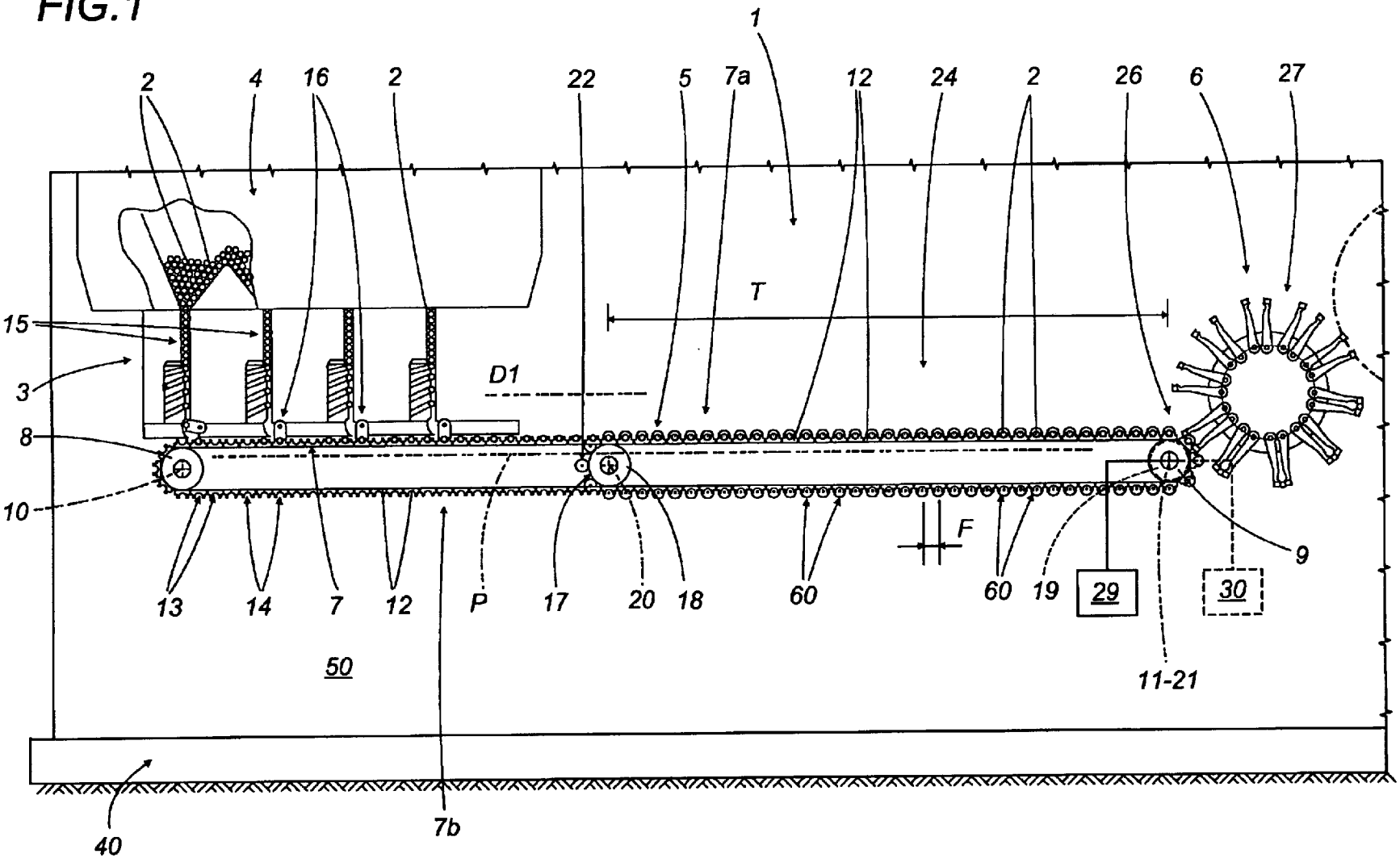
FIG. 1 shows a portion of a cigar making machine embodied in accordance with the present invention, illustrated schematically in elevation.
Figure 2:
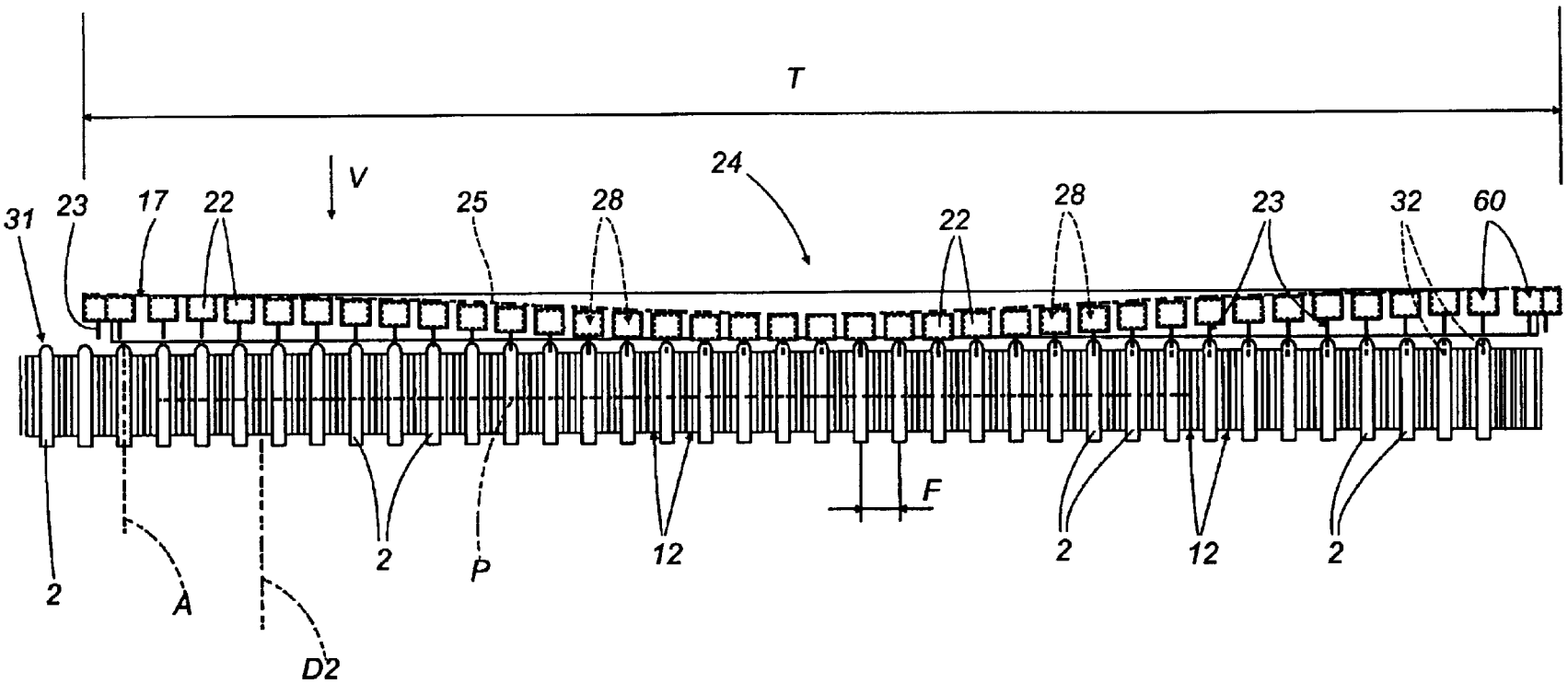
FIG. 2 shows the portion of the cigar making machine as in FIG. 1, illustrated schematically in a plan view.

Referring to FIGS. 1 and 2 of the accompanying drawings, 1 denotes a portion of a machine for the manufacture of cigars 2, comprising a frame 40, and a vertical bulkhead 50 supported by the frame.

The machine 1 also comprises a temporary storage and distribution station 3 carried by the vertical bulkhead 50, at which the cigars 2 are fed singly and in succession from a hopper 4, forming part of the station 3, onto a conveyor denoted 5.

The conveyor 5 serves to transfer the cigars 2 in a given direction D1 and along a predetermined feed path P toward a treatment station 6 of conventional type, illustrated only in part.

The conveyor 5 comprises a belt 7 looped around two pulleys 8 and 9 of which one only, denoted 9 in FIG. 1, is power driven and turns continuously.

The pulleys 8 and 9 are carried by the vertical bulkhead 50 and rotatable about respective axes 10 and 11 disposed normal to the viewing plane of FIG. 1, whilst the belt 7 carries a plurality of blocks 12 distributed uniformly at a predetermined pitch F along the outwardly directed surface of the loop.

The blocks 12 are fashioned each with a groove 13 extending parallel to the axes 10 and 11 of the pulleys and establishing a respective pocket 14 in which to accommodate a respective cigar 2, disposed with its longitudinal axis A extending parallel to the aforementioned axes 10 and 11 of rotation and transversely to the conveying direction D1.

The belt 7 of the conveyor 5 affords an active top branch 7*a* by which the blocks 12 are carried along the feed path P, and a bottom branch 7*b* along which the blocks are returned toward the temporary storage and distribution station 3.

The temporary storage and distribution station 3, which is of conventional embodiment and therefore not described further, also comprises a plurality of substantially vertical channels 15 and relative transfer mechanisms 16 by which the cigars 2 are directed singly and in ordered succession into the pockets 14 of the conveyor 5.

The machine 1 further comprises a belt 17 looped around two pulleys 18 and 19 of which one only, denoted 19, is power driven and turns continuously.

The pulleys 18 and 19 are carried by the vertical bulkhead 50 and rotatable about respective axes 20 and 21 disposed normal to the viewing plane of FIG. 1, whilst the belt 17 carries a plurality of heads 22 distributed uniformly at a predetermined pitch F along the outwardly directed surface of the loop.

The heads 22 are provided each with a respective piercing needle 23 that extends in a direction D2 parallel to the longitudinal axis A of the single cigar 2.

The belt 17 extends parallel to the conveyor 5 described above, running directly alongside through a set distance denoted T; the two belts 7 and 17 thus combine to establish a station 24 at which the cigars 2 are pierced.

The needle heads 22 are advanced by the belt 17 in such a way as to move synchronously with the belt 7 of the conveyor 5 along the feed path P, each one travelling through the aforementioned distance T in alignment with a respective pocket 14 accommodating a single cigar 2.

The needle heads 22 are capable of movement in the aforementioned direction D2, toward and away from the pockets 14 accommodating the cigars 2, in such a way that the needles 23 are made to engage the single cigars 2 and then disengage, according to a given law of motion.

Referring to FIG. 2, the machine 1 comprises a cam element 25 of which the profile is indicated by a phantom line, serving to generate the movement of the needle heads 22.

In short, during the course of its passage along the feed path P, each needle head 22 is caused to translate in the aforementioned direction D2, hence transverse to the selfsame path P, as a result of interacting with the profile of the cam element 25. The heads 22 will engage the cam profile by way of conventional interface mechanisms not illustrated in the drawings.

As indicated in FIG. 1, the treatment station 6 is disposed facing an exit end 26 of the conveyor 5 and presents a plurality of conventional wrapping and packaging devices of which one only, a transfer wheel 27, is illustrated.

Each needle head 22 is equipped with a device 28, located internally, by which the relative needle 23 can be heated and maintained at a temperature such as will ensure the cigar 2 is efficiently pierced.

The needle heads 22 and the relative needles 23 together constitute means 60 by which to pierce the cigars 2.

In operation, cigars 2 collecting internally of the hopper 4 will work their way down the vertical channels 15 and are then positioned by the transfer mechanisms 16 in the respective pockets 14 afforded by the blocks 12 associated with the belt 7 of the conveyor 5, arranged in an ordered succession.

The belt 7 is set in motion by an actuator of familiar type, indicated schematically in FIG. 1 by a block denoted 29, in such a way as to advance the pockets 14 continuously along the feed path P followed by the active branch 7*a* of the conveyor 5.

As the cigars 2 enter the piercing station 24, each occupying a respective pocket 14, each of the blocks 12 will be joined alongside by a relative needle head 22 carried and advanced by the relative belt 17, driven by an actuator likewise of familiar type indicated schematically in FIG. 1 by a block denoted 30.

In an alternative embodiment of the invention, not illustrated, the belts 7 and 17 might be timed and driven synchronously by a single actuator.

Each block 12 proceeds along the feed path P for the entire set distance T aforementioned, advancing in alignment with the needle head 22 alongside.

As discernible in FIG. 2, the needle heads 22 are displaced as they advance along the feed path P and through the set distance T, moving transversely to the selfsame path P in the direction denoted D2, in such a manner that the needles 23 are caused to engage the corresponding cigars 2.

In other words, the needle heads 22 are invested with movement in the aforementioned direction D2 toward and away from the cigars 2 occupying the pockets 14, to the end of causing the needles 23 first to penetrate and then to withdraw from the cigars 2.

The movement of the heads 22 in the transverse direction D2, within the distance T compassed by the piercing station 24, is brought about according to the aforementioned law of motion imposed by the profile of the cam element 25.

The needle heads 22 are afforded the necessary freedom of movement in the transverse direction D2, in relation to the belt 17, by means of sliding devices such as glides, for example, conventional in embodiment and therefore not illustrated in the drawings.

The sliding devices in question combine with the cam element 25 to constitute means, likewise not illustrated, by which movement is transmitted to the needle heads 22.

Observing FIG. 2, it will be seen that in the course of advancing along the set distance T of the piercing station 24, the needle 23 of each head 22 is inserted gradually into an end portion 31 of a respective cigar 2, penetrating to a certain depth in a direction V concurrent with the longitudinal axis A of the cigar 2.

Penetrating thus into the cigar 2, accordingly, the needle 23 forms a hole 32 aligned substantially on the longitudinal axis A and, as a result of the thermal effect induced by the heating device 28 aforementioned, subjects the internal surface of the hole 32 to a heat-stretching action that has the effect of preventing the selfsame hole 32 from closing up after the needle 23 is withdrawn.

As readily discernible in FIG. 2, the needle 23 remains inside the hole 32 for a given conveying distance, and therefore for a certain interval of time, precisely to ensure that the heat-stretching action will be applied effectively to the internal surface of the hole 32.

On reaching the aforementioned exit end 26 of the conveyor 5, the single needle head 22 assumes a limit position of maximum distance from the cigars, and more exactly, fully withdrawn from the single cigar 2 in which it has just pierced a hole 32.

Likewise at the exit end 26 of the conveyor 5, the cigars 2 pierced with a hole 32 are taken up singly and in succession by the transfer wheel 27 of the treatment station 6 which, to reiterate, is illustrated only in part.

The blocks 12 affording the pockets 14 occupied by the cigars 2 will present locating elements, not illustrated, each functioning as a reaction surface for the relative cigar 2 when pressure is applied during the piercing action of the head 22, and serving to maintain the correct position of the cigar 2 in the pocket 14.

Advantageously, the profile of the cam element 25 can be varied to the end of controlling the speed at which the needle 23 penetrates the cigar 2, so as to optimize the piercing step not least with the different dimensional and/or constituent features of the cigar 2 in mind, and to avoid damaging the product.

In an alternative embodiment of the invention, not illustrated in the drawings, the pockets 14 occupied by the cigars 2 are capable of movement toward and away from the needle heads 22 in the direction D2 parallel to the longitudinal axis A of the cigar, in such a way that the cigars 2 are made to engage the needles 23 and then to disengage, according to a given law of motion. In effect, this alternative solution is one in which the needles 23 advance along the feed path P staying substantially motionless in the transverse direction D2, whilst it is the pockets 14 accommodating the cigars 2 that move in this same direction D2 while advancing along the feed path P.

In a further embodiment, not illustrated, the conveyor is embodied not as a belt 7 but as a wheel carrying the pockets 14 occupied by the cigars 2. In this instance it is the surface of revolution of the wheel that establishes the feed path P along which the cigars 2 advance continuously. Likewise in this instance the heads 22 will be carried not by a belt 17 but by a wheel breasted axially with the wheel carrying the pockets 14. The two wheels rotate continuously, timed and synchronized one with another.

Finally, in yet another alternative solution, the pockets 14 and the needle heads 22 could both be carried by one continuously rotating wheel.

What is claimed is:

1. A method of conditioning cigars, comprising the steps of:

arranging the cigars in an ordered succession on respective holder elements;

advancing the cigars and the holder elements continuously along a predetermined feed path;

piercing a hole in at least one end of each cigar, substantially parallel with a longitudinal axis of the selfsame cigar, during the continuous movement of the cigars along the predetermined feed path;

the step of piercing a hole in each cigar being effected through the agency of piercing means capable of movement along the predetermined feed path synchronously with the cigars.

2. A method as in claim 1, wherein the cigars are pierced by piercing means comprising a plurality of needles carried by respective needle heads.

3. A method as in claim 2, comprising the further step of heating the piercing means.

4. A method as in claim 1, comprising the further step of heating the piercing means.

5. A method of conditioning cigars, comprising the steps of:

arranging the cigars in an ordered succession on respective holder elements;

advancing the cigars and the holder elements continuously along a predetermined feed path;

piercing a hole with a piercing needle in at least one end of each cigar, substantially parallel with a longitudinal axis of the selfsame cigar, during the continuous movement of the cigars along the predetermined feed path, the piercing needle being moved along the predetermined feed path synchronously with the cigars during the piercing step.

6. A method as in claim 5, wherein a plurality of cigars are generally simultaneously pierced by a plurality of piercing needles carried by respective needle heads and moving synchronously with the plurality of cigars.

7. A method as in claim 6, comprising the further step of heating the piercing needles.

* * * * *